US006072884A

United States Patent [19]

Kates

[11] Patent Number: 6,072,884

[45] **Date of Patent: *Jun. 6, 2000**

[54] FEEDBACK CANCELLATION APPARATUS AND METHODS

[75] Inventor: James Mitchell Kates, Niwot, Colo.

[73] Assignee: AudioLogic Hearing Systems LP, Boulder, Colo.

[ * ] Notice: This patent is subject to a terminal disclaimer.

[21] Appl. No.: 08/972,265

[22] Filed: Nov. 18, 1997

[51] Int. Cl.[7] ..... H04R 25/00

[52] U.S. Cl. ..... 381/318; 381/71.11; 381/93; 381/71.8

[58] Field of Search ..... 381/312, 318, 381/320, 71.8, 71.11, 71.12, 92, 93, 66, 313

[56] References Cited

U.S. PATENT DOCUMENTS

| | | | |
|---|---|---|---|
| 4,689,818 | 8/1987 | Ammitzboll | 381/68 |
| 4,731,850 | 3/1988 | Levitt et al. | 381/68.2 |
| 5,016,280 | 5/1991 | Engebretson et al. | 381/68 |
| 5,019,952 | 5/1991 | Smolenski et al. | 363/16 |
| 5,091,952 | 2/1992 | Williamson et al. | 381/313 |

OTHER PUBLICATIONS

Kates, James M., "Feedback Cancellation in Hearing Aids: Results from a Computer Simulation," IEEE Transactions on Signal Processing, vol. 39, No. 3, 1991, 553–562.

Maxwell, Joseph A. And Patrick M Zurek, "Reducing Acoustic Feedback in Hearing Aids," IEEE Transactions on Speech and Audio Processing, vol. 3, No. 4, 1995, 304–313.

Greenberg, Julie E. And Patrick M. Zurek, "Evaluation of an Adaptive Beamforming Method for Hearing Aids," The Journal of the Acoustical Society of America, vol. 91, No. 3, 1992, 1662–1676.

Minnesota Mining and Manufacturing Company, European Patent Application for "Auditory Prosthesis with User–Controlled Feedback," Application No. 93112049.7, filed on Jul. 28, 1993.

Minnesota Mining and Manufacturing Company, European Patent Application for "Auditory Prosthesis, Noise Suppression Apparatus and Feedback Suppression Apparatus Having Focused Adapted Filtering," Application No. 93111138.9, filed on Jul. 12, 1993.

Lybarger, Samuel F., "Acoustic Feedback Control," *The Vanderbilt Hearing–Aid Report*, Studebaker and Bess, Eds. Upper Darby, PA: Monographs in Contemporary Audiology, pp. 87–90, 1982.

Kates, James M., "A Computer Simulation of Hearing Aid Response and the Effects of Ear Canal Size," J. Acoust. Soc. Am., vol. 83 (5), pp. 1952–1963, May 1988.

Egolf, David P., "Review of the Acoustic Feedback Literature from a Control Systems Point of view," *The Vanderbilt Hearing–Aid Report*, Studebaker and Bess, Eds. Upper Darby, PA: Monographs in Contemporary Audiology, pp. 94–103, 1982.

(List continued on next page.)

*Primary Examiner*—Curtis A. Kuntz
*Assistant Examiner*—Dionne N. Harvey
*Attorney, Agent, or Firm*—Jennifer L. Bales; Macheledt Bales & Johnson LLP

[57] ABSTRACT

Feedback cancellation apparatus uses a cascade of two filters along with a short bulk delay. The first filter is adapted when the hearing aid is turned on in the ear. This filter adapts quickly using a white noise probe signal, and then the filter coefficients are frozen. The first filter models parts of the hearing-aid feedback path that are essentially constant over the course of the day. The second filter adapts while the hearing aid is in use and does not use a separate probe signal. This filter provides a rapid correction to the feedback path model when the hearing aid goes unstable, and more slowly tracks perturbations in the feedback path that occur in daily use. The delay shifts the filter response to make the most effective use of the limited number of filter coefficients.

24 Claims, 9 Drawing Sheets

OTHER PUBLICATIONS

Bustamante, Diane K., Thomas L. Worrall, and Malcolm J. Williamson, "Measurement and Adaptive Suppression of Acoustic Feedback in Hearing Aids," ICASSP '89 Proceedings, Glasgow, pp. 2017–2020, 1989.

Engebretson, A. Maynard, Michael P. O'Connell, and Fengmin Gong, "An Adaptive Feedback Equalization Algorithm for the CID Digital Hearing Aid," Annual International Conference for the IEEE Engineering in Medicine and Biology Society, Part 5, vol. 12, No. 5, Philadelphia, PA, pp. 2286–2287, 1990.

Kates, James M., "Feedback Cancellation in Hearing Aids: Results from a Computer Simulation," IEEE Transactions on Signal Processing, vol. 39, No. 3, pp. 553–562, Mar. 1991.

Dyrlund, Ole and Nikolai Bisgaard, "Acoustic Feedback Margin Improvements in Hearing Instruments Using a Prototype DFS (Digital Feedback Suppression) System,"Scand Audiol, vol. 20, pp. 49–53, 1991.

Engebretson, A. Maynard, and Marilyn French–St. George, "Properties of an Adaptive Feedback Equalization Algorithm," Journal of Rehabilitation Research and Development, vol. 30, No. 1, pp. 8–16, 1993.

French–St. George, Marilyn, Douglas J. Wood, and A. Maynard Engebretson, "Behavioral Assessment of Adaptive Feedback Equalization in a Digital Hearing Aid," Journal of Rehabilitation Research and Development, vol. 30, No. 1, pp. 17–25, 1993.

Bisgaard, Nikolai, "Digital Feedback Suppression—Clinical Experiences with Profoundly Hearing Impaired," *Recent Developments in Hearing Instrument Technology: 15th Danavox Symposium*, J. Beilin and G.R. Jensen, Eds., Kolding, Denmark, pp. 370–384, 1993.

Dyrlund, Ole, Lise B. Henningsen, Nikolai Bisgaard, and Janne H. Jensen, "Digital Feedback Suppression: Characterization of Feedback–margin Improvements in a DFS Hearing Instrument," Scand. Audiol., vol. 23, pp. 135–138, 1994.

Widrow, Bernard, John M. McCool, Michael G. Larimore, and C. Richard Johnson, Jr., "Stationary and Nonstationary Learning Characteristics of the LMS Adaptive Filter," Proc. IEEE, vol. 64, No. 8, pp. 1151–1162, Aug. 1976.

Maxwell Joseph A., and Patrick M. Zurek, "Reducing Acoustic Feedback in Hearing Aids," IEEE Transactions on Speech and Audion Processing, vol. 3, No. 4, Jul. 1995.

Makhoul, John, "Linear Prediction: A Tutorial Review," Proceedings of the IEEE, vol. 63, No. 4, pp. 561–580, Apr. 1975.

Woodruff, Brian D., and David A Preves, "Fixed Filter Implementation of Feedback Cancellation for In–The–Ear Hearing Aids," Proc. 1995 IEEE ASSP Workshop on Applications of Signal Processing to Audio and Acoustics, New Paltz, NY, paper 1.5, 1995.

Ho, K.C., and Y.T. Chan, "Bias Removal in Equation–Error Adaptive IIR Filters," IEEE Transactions on Signal Processing, vol. 43, No. 1, pp. 51–62, Jan. 1995.

FEEDBACK CANCELLATION APPARATUS AND METHODS

BACKGROUND OF THE INVENTION

1. Field of the Invention

The present invention relates to apparatus and methods for canceling feedback in audio systems such as hearing aids.

2. Description of the Prior Art

Mechanical and acoustic feedback limits the maximum gain that can be achieved in most hearing aids (Lybarger, S. F., "Acoustic feedback control", The Vanderbilt Hearing-Aid Report, Studebaker and Bess, Eds., Upper Darby, Pa.: Monographs in Contemporary Audiology, pp 87–90, 1982). System instability caused by feedback is sometimes audible as a continuous high-frequency tone or whistle emanating from the hearing aid. Mechanical vibrations from the receiver in a high-power hearing aid can be reduced by combining the outputs of two receivers mounted back-to-back so as to cancel the net mechanical moment; as much as 10 dB additional gain can be achieved before the onset of oscillation when this is done. But in most instruments, venting the BTE earmold or ITE shell establishes an acoustic feedback path that limits the maximum possible gain to less than 40 dB for a small vent and even less for large vents (Kates, J. M., "A computer simulation of hearing aid response and the effects of ear canal size", J. Acoust. Soc. Am., Vol. 83, pp 1952–1963, 1988). The acoustic feedback path includes the effects of the hearing-aid amplifier, receiver, and microphone as well as the vent acoustics.

The traditional procedure for increasing the stability of a hearing aid is to reduce the gain at high frequencies (Ammitzboll, K., "Resonant peak control", U.S. Pat. No. 4,689,818, 1987). Controlling feedback by modifying the system frequency response, however, means that the desired high-frequency response of the instrument must be sacrificed in order to maintain stability. Phase shifters and notch filters have also been tried (Egolf, D. P., "Review of the acoustic feedback literature from a control theory point of view", The Vanderbilt Hearing-Aid Report, Studebaker and Bess, Eds., Upper Darby, Pa.: Monographs in Contemporary Audiology, pp 94–103, 1982), but have not proven to be very effective.

A more effective technique is feedback cancellation, in which the feedback signal is estimated and subtracted from the microphone signal. Computer simulations and prototype digital systems indicate that increases in gain of between 6 and 17 dB can be achieved in an adaptive system before the onset of oscillation, and no loss of high-frequency response is observed (Bustamante, D. K., Worrell, T. L., and Williamson, M. J., "Measurement of adaptive suppression of acoustic feedback in hearing aids", Proc. 1989 Int. Conf. Acoust. Speech and Sig. Proc., Glasgow, pp 2017–2020, 1989; Engebretson, A. M., O'Connell, M. P., and Gong, F., "An adaptive feedback equalization algorithm for the CID digital hearing aid", Proc. 12th Annual Int. Conf. of the IEEE Eng. in Medicine and Biology Soc., Part 5, Philadelphia, Pa, pp 2286–2287, 1990; Kates, J. M., "Feedback cancellation in hearing aids: Results from a computer simulation", IEEE Trans. Sig. Proc., Vol.39, pp 553–562, 1991; Dyrlund, O., and Bisgaard, N., "Acoustic feedback margin improvements in hearing instruments using a prototype DFS (digital feedback suppression) system", Scand. Audiol., Vol. 20, pp 49–53, 1991; Engebretson, A. M., and French-St. George, M., "Properties of an adaptive feedback equalization algorithm", J. Rehab. Res. and Devel., Vol. 30, pp 8–16, 1993; Engebretson, A. M., O'Connell, M. P., and Zheng, B., "Electronic filters, hearing aids, and methods", U.S. Pat. No. 5,016,280; Williamson, M. J., and Bustamante, D. K., "Feedback suppression in digital signal processing hearing aids," U.S. Pat. No. 5,019,952).

In laboratory tests of a wearable digital hearing aid (French-St. George, M., Wood, D. J., and Engebretson, A. M., "Behavioral assessment of adaptive feedback cancellation in a digital hearing aid", J. Rehab. Res. and Devel., Vol. 30, pp 17–25, 1993), a group of hearing-impaired subjects used an additional 4 dB of gain when adaptive feedback cancellation was engaged and showed significantly better speech recognition in quiet and in a background of speech babble. Field trials of a feedback-cancellation system built into a BTE hearing aid have shown increases of 8–10 dB in the gain used by severely-impaired subjects (Bisgaard, N., "Digital feedback suppression: Clinical experiences with profoundly hearing impaired", In Recent Developments in Hearing Instrument Technology: 15th Danavox Symposium, Ed. by J. Beilin and G. R. Jensen, Kolding, Denmark, pp 370–384, 1993) and increases of 10–13 dB in the gain margin measured in real ears (Dyrlund, O., Henningsen, L. B., Bisgaard, N., and Jensen, J. H., "Digital feedback suppression (DFS): Characterization of feedback-margin improvements in a DFS hearing instrument", Scand. Audiol., Vol. 23, pp 135–138, 1994).

In some systems, the characteristics of the feedback path are estimated using a noise sequence continuously injected at a low level (Engebretson and French-St.George, 1993; Bisgaard, 1993, referenced above). The weight update of the adaptive filter also proceeds on a continuous basis, generally using the LMS algorithm (Widrow, B., McCool, J. M., Larimore, M. G., and Johnson, C. R., Jr., "Stationary and nonstationary learning characteristics of the LMS adaptive filter", Proc. IEEE, Vol. 64, pp 1151–1162, 1976). This approach results in a reduced SNR for the user due to the presence of the injected probe noise. In addition, the ability of the system to cancel the feedback may be reduced due to the presence of speech or ambient noise at the microphone input (Kates, 1991, referenced above; Maxwell, J. A., and Zurek, P. M., "Reducing acoustic feedback in hearing aids", IEEE Trans. Speech and Audio Proc., Vol. 3, pp 304–313, 1995). Better estimation of the feedback path will occur if the hearing-aid processing is turned off during the adaptation so that the instrument is operating in an open-loop rather than closed-loop mode while adaptation occurs (Kates, 1991). Furthermore, for a short noise burst used as the probe in an open-loop system, solving the Wiener-Hopf equation (Makhoul, J. "Linear prediction: A tutorial review," Proc. IEEE, Vol. 63, pp 561–580, 1975) for the optimum filter weights can result in greater feedback cancellation than found for LMS adaptation (Kates, 1991). For stationary conditions up to 7 dB of additional feedback cancellation is observed solving the Wiener-Hopf equation as compared to a continuously-adapting system, but this approach can have difficulty in tracking a changing acoustic environment because the weights are adapted only when a decision algorithm ascertains the need and the bursts of injected noise can be annoying (Maxwell and Zurek, 1995, referenced above).

A simpler approach is to use a fixed approximation to the feedback path instead of an adaptive filter. Levitt, H., Dugot, R. S., and Kopper, K. W., "Programmable digital hearing aid system", U.S Pat. No. 4,731,850, 1988, proposed setting the feedback cancellation filter response when the hearing aid was fitted to the user. Woodruff, B. D., and Preves, D. A., "Fixed filter implementation of feedback cancellation for in-the-ear hearing aids", Proc. 1995 IEEE ASSP Workshop on Applications of Signal Processing to Audio and Acoustics, New Paltz, N.Y., paper 1.5, 1995, found that a feedback cancellation filter constructed from the average of the responses of 13 ears gave an improvement of 6–8 dB in maximum stable gain for an ITE instrument, while the optimum filter for each ear gave 9–11 dB improvement.

A need remains in the art for apparatus and methods to eliminate "whistling" due to feedback in unstable hearing-aids.

SUMMARY OF THE INVENTION

The primary objective of the feedback cancellation processing of the present invention is to eliminate "whistling" due to feedback in an unstable hearing-aid amplification system. The processing should provide an additional 10 dB of allowable gain in comparison with a system not having feedback cancellation. The presence of feedback cancellation should not introduce any artifacts in the hearing-aid output, and it should not require any special understanding on the part of the user to operate the system.

The feedback cancellation of the present invention uses a cascade of two adaptive filters along with a short bulk delay. The first filter is adapted when the hearing aid is turned on in the ear. This filter adapts quickly using a white noise probe signal, and then the filter coefficients are frozen. The first filter models those parts of the hearing-aid feedback path that are assumed to be essentially constant while the hearing aid is in use, such as the microphone, amplifier, and receiver resonances, and the basic acoustic feedback path.

The second filter adapts while the hearing aid is in use and does not use a separate probe signal. This filter provides a rapid correction to the feedback path model when the hearing aid goes unstable, and more slowly tracks perturbations in the feedback path that occur in daily use such as caused by chewing, sneezing, or using a telephone handset. The bulk delay shifts the filter response so as to make the most effective use of the limited number of filter coefficients.

A hearing aid according to the present comprises a microphone for converting sound into an audio signal, feedback cancellation means including means for estimating a physical feedback signal of the hearing aid, and means for modelling a signal processing feedback signal to compensate for the estimated physical feedback signal, subtracting means, connected to the output of the microphone and the output of the feedback cancellation means, for subtracting the signal processing feedback signal from the audio signal to form a compensated audio signal, a hearing aid processor, connected to the output of the subtracting means, for processing the compensated audio signal, and a speaker, connected to the output of the hearing aid processor, for converting the processed compensated audio signal into a sound signal.

The feedback cancellation means forms a feedback path from the output of the hearing aid processing means to the input of the subtracting means and includes a first filter for modeling near constant factors in the physical feedback path, and a second, quickly varying, filter for modeling variable factors in the feedback paths. The first filter varies substantially slower than the second filter.

In a first embodiment, the first filter is designed when the hearing aid is turned on and the design is then frozen. The second filter is also designed when the hearing aid is turned on, and adapted thereafter based upon the output of the subtracting means and based upon the output of the hearing aid processor.

The first filter may be the denominator of an IIR filter and the second filter may be the numerator of said IIR filter. In this case, the first filter is connected to the output of the hearing aid processor, for filtering the output of the hearing aid processor, and the output of the first filter is connected to the input of the second filter, for providing the filtered output of the hearing aid processor to the second filter.

Or, the first filter might be an IIR filter and the second filter an FIR filter.

The means for designing the first filter and the means for designing the second filter comprise means for disabling the input to the speaker means from the hearing aid processing means, a probe for providing a test signal to the input of the speaker means and to the second filter, means for connecting the output of the microphone to the input of the first filter, means for connecting the output of the first filter and the output of the second filter to the subtraction means, means for designing the second filter based upon the test signal and the output of the subtraction means, and means for designing the first filter based upon the output of the microphone and the output of the subtraction means.

The means for designing the first filter may further include means for detuning the filter, and the means for designing the second filter may further include means for adapting the second filter to the detuned first filter.

In a second embodiment, the hearing aid includes means for designing the first filter when the hearing aid is turned on, means for designing the second filter when the hearing aid is turned on, means for slowly adapting the first filter, and means for rapidly adapting the second filter based upon the output of the subtracting means and based upon the output of the hearing aid processing means.

In the second embodiment, the means for adapting the first filter might adapts the first filter based upon the output of the subtracting means, or based upon the output of the hearing aid processing means.

A dual microphone embodiment of the present invention hearing aid comprises a first microphone for converting sound into a first audio signal, a second microphone for converting sound into a second audio signal, feedback cancellation means including means for estimating physical feedback signals to each microphone of the hearing aid, and means for modelling a first signal processing feedback signal to compensate for the estimated physical feedback signal to the first microphone and a second signal processing feedback signal to compensate for the estimated physical feedback signal to the second microphone, means for subtracting the first signal processing feedback signal from the first audio signal to form a first compensated audio signal, means for subtracting the second signal processing feedback signal from the second audio signal to form a second compensated audio signal, beamforming means, connected to each subtracting means, to combine the compensated audio signals into a beamformed signal, a hearing aid processor, connected to the beamforming means, for processing the beamformed signal, and a speaker, connected to the output of the hearing aid processing means, for converting the processed beamformed signal into a sound signal.

The feedback cancellation means includes a slower varying filter, connected to the output of the hearing aid processing means, for modeling near constant environmental factors in one of the physical feedback paths, a first quickly varying filter, connected to the output of the slower varying filter and providing an input to the first subtraction means, for modeling variable factors in the first feedback path, and a second quickly varying filter, connected to the output of the slowly varying filter and providing an input to the second subtraction means, for modeling variable factors in the second feedback path. The slower varying filter varies substantially slower than said quickly varying filters.

In a first version of the dual microphone embodiment, the hearing aid further includes means for designing the slower varying filter when the hearing aid is turned on, and means for freezing the slower varying filter design. It also includes means for designing the first and second quickly varying filters when the hearing aid is turned on, means for adapting the first quickly varying filter based upon the output of the first subtracting means and based upon the output of the hearing aid processing means, and means for adapting the second quickly varying filter based upon the output of the second subtracting means and based upon the output of the hearing aid processing means.

In this embodiment, the first quickly varying filter might be the denominator of a first IIR filter, the second quickly varying filter might be the denominator of a second IIR filter, and the slower varying filter might be based upon the numerator of at least one of these IIR filters. Or, the slower varying filter might be an IIR filter and the rapidly varying filters might be FIR filters.

In the dual microphone embodiment, the means for designing the slower varying filter and the means for designing the rapidly varying filters might comprise means for disabling the input to the speaker means from the hearing aid processing means, probe means for providing a test signal to the input of the speaker means and to the rapidly varying filters, means for connecting the output of the first microphone to the input of the slower varying filter, means for connecting the output of the slower varying filter and the output of the first rapidly varying filter to the first subtraction means, means for designing the first rapidly varying filter based upon the test signal and the output of the first subtraction means, means for connecting the output of the slower varying filter and the output of the second rapidly varying filter to the second subtraction means, means for designing the second rapidly varying filter based upon the test signal and the output of the second subtraction means, and means for designing the slower varying filter based upon the output of the microphone and the output of at least one of the subtraction means.

The means for designing the slower varying filter might further include means for detuning the slower varying filter, and tile means for designing the quickly varying filters might further include means for adapting the quickly varying filters to the detuned slower varying filter.

Another vesrion of the dual microphone embodiment might include means for designing the slower varying filter when the hearing aid is turned on, means for designing the quickly varying filters when the hearing aid is turned on, means for slowly adapting the slower varying filter, means for rapidly adapting the first quickly varying filter based upon the output of the first subtracting means and based upon the output of the hearing aid processing means, and means for rapidly adapting the second quickly varying filter based upon the output of the second subtracting means and based upon the output of the hearing aid processing means.

In this case, the means for adapting the slower varying filter might adapt the slower varying filter based upon the output of at least one of the subtracting means, or might adapt the slower varying filter based upon the output of the hearing aid processing means.

DETAILED DESCRIPTION OF THE PREFERRED EMBODIMENT

Figure 1:
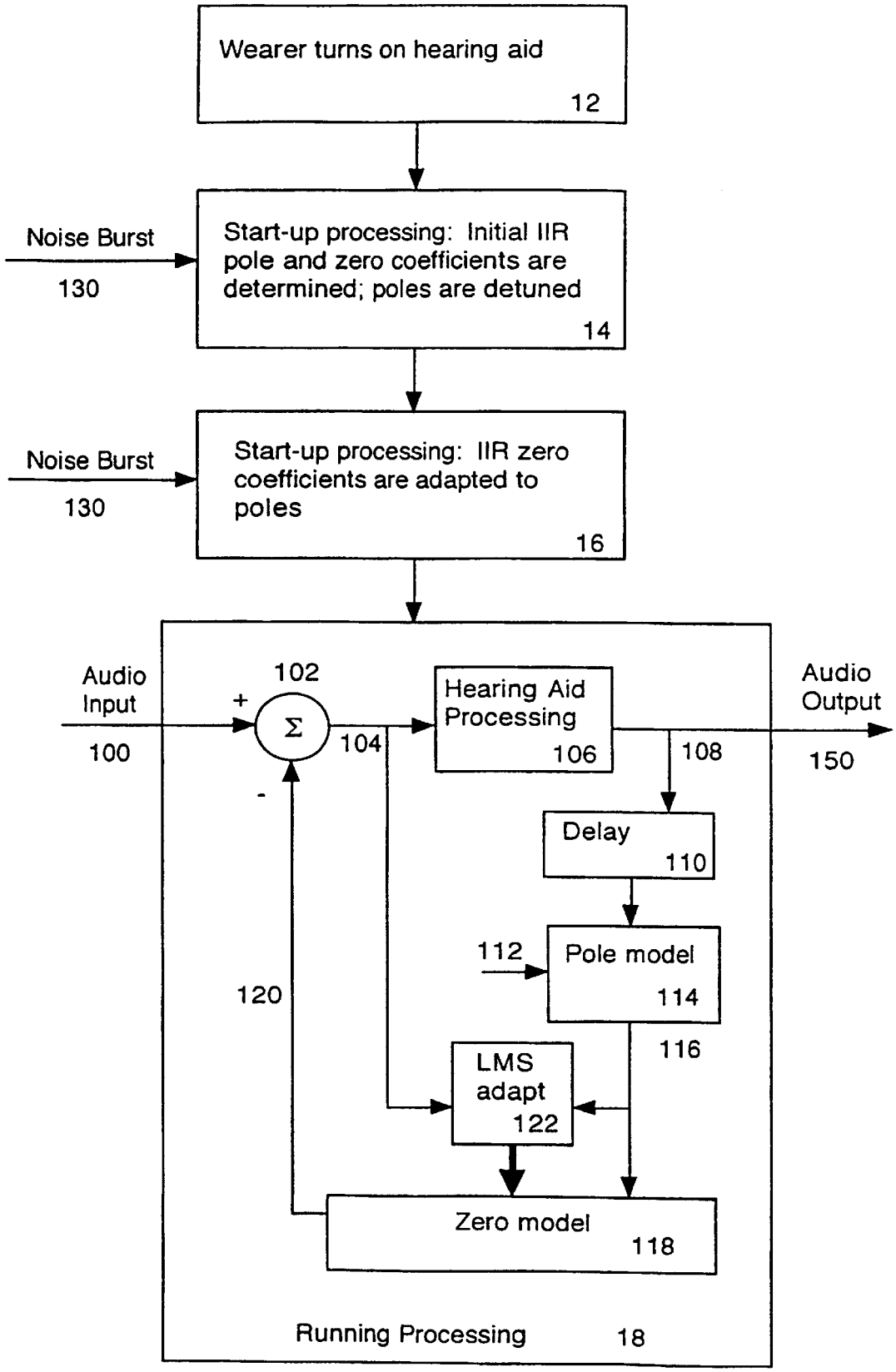
FIG. 1 is a flow diagram showing the operation of a hearing aid according to the present invention.

FIG. 1 is a flow diagram showing the operation of a hearing aid according to the present invention. In step 12, the wearer of the hearing aid turns the hearing aid on. Step 14 and 16 comprise the start-up processing operations, and step 18 comprises the processing when the hearing aid is in use.

In the preferred embodiment of the present invention, the feedback cancellation uses an adaptive filter, such as an IIR filter, along with a short bulk delay. The filter is designed when the hearing aid is turned on in the ear. In step 14, the filter, preferably comprising an IIR filter with adapting numerator and denominator portions, is designed. Then, the denominator portion of the IIR filter is preferably frozen. The numerator portion of the filter, now a FIR filter, still adapts. In step 16, the initial zero coefficients are modified to compensate for changes to the pole coefficients in step 14. In step 18, the hearing aid is turned on and operates in closed loop. The zero (FIR) filter, consisting of the numerator of the IIR filter developed during start-up, continues to adapt in real time.

In step 14, the IIR filter design starts by exciting the system with a short white-noise burst, and cross-correlating the error signal with the signal at the microphone and with the noise which was injected just ahead of the amplifier. The normal hearing-aid processing is turned off so that the open-loop system response can be obtained, giving the most accurate possible model of the feedback path. The cross-correlation is used for LMS adaptation of the pole and zero filters modeling the feedback path using the equation-error approach (Ho, K. C. and Chan, Y. T., "Bias removal in equation-error adaptive IIR filters", IEEE Trans. Sig. Proc., Vol. 43, pp 51–62, 1995). The poles are then detuned to reduce the filter Q values in order to provide for robustness in dealing in shifts in the resonant system behavior that may occur in the feedback path. The operation of step 14 is shown in more detail in FIG. 2. After step 14, the pole filter coefficients are frozen.

In step 16 the system is excited with a second noise burst, and the output of the all-pole filter is used in series with the zero filter. LMS adaptation is used to adapt the model zero coefficients to compensate for the changes made in detuning the pole coefficients. The LMS adaptation yields the optimal numerator of the IIR filter given the detuned poles. The operation of step 16 is shown in more detail in FIG. 3. Note that the changes in the zero coefficients that occur in step 16 are in general very small. Thus step 16 may be eliminated with only a slight penalty in system performance.

After steps 14 and 16 are performed, the running hearing aid operation 18 is initiated. The pole filter models those parts of the hearing-aid feedback path that are assumed to be essentially constant while the hearing aid is in use, such as the microphone, amplifier, and receiver resonances, and the resonant behavior of the basic acoustic feedback path.

Step 18 comprises all of the running operations taking place in the hearing aid. Running operations include the following:

1) Conventional hearing aid processing of whatever type is desired. For example, dynamic range compression or noise suppression;
2) Adaptive computation of the second filter, preferably a FIR (all-zero) filter;
3) Filtering of the output of the hearing aid processing by the frozen all-pole filter and the adaptive FIR filter.

In the specific embodiment shown in FIG. 1, audio input 100, for example from the hearing aid microphone (not shown) after subtraction of a cancellation signal 120 (described below), is processed by hearing aid processing 106 to generate audio output 150, which is delivered to the hearing aid amplifier (not shown), and signal 108. Signal 108 is delayed by delay 110, which shifts the filter response so as to make the most effective use of the limited number of zero filter coefficients, filtered by all-pole filter 114, and filtered by FIR filter 118 to form a cancellation signal 120, which is subtracted from input signal 100 by adder 102.

Optional adaptive signal 112 is shown in case pole filter 114 is not frozen, but rather varies slowly, responsive to adaptive signal 112 based upon error signal 104, feedback signal 108, or the like.

FIR filter 118 adapts while the hearing aid is in use, without the use of a separate probe signal. In the embodiment of FIG. 1, the FIR filter coefficients are generated in LMS adapt block 122 based upon error signal 104 (out of adder 102) and input 116 from all-pole filter 114. FIR filter 118 provides a rapid correction to the feedback path when the hearing aid goes unstable, and more slowly tracks perturbations in the feedback path that occur in daily use such as caused by chewing, sneezing, or using a telephone handset. The operation of step 18 is shown in more detail in the alternative embodiments of FIGS. 4 and 6.

In the preferred embodiment, there are a total of 7 coefficients in all-pole filter 114 and 8 in FIR filter 118, resulting in 23 multiply-add operations per input sample to design FIR filter 118 and to filter signal 108 through all-pole filter 114 and FIR filter 118. The 23 multiply-add operations per input sample result in approximately 0.4 million instructions per second (MIPS) at a 16-kHz sampling rate. An adaptive 32-tap FIR filter would require a total of 1 MIPS. The proposed cascade approach thus gives performance as good as, if not better than, other systems while requiring less than half the number of numerical operations per sample.

The user will notice some differences in hearing-aid operation resulting from the feedback cancellation. The first difference is the request that the user turn the hearing aid on in the ear, in order to have the IIR filter correctly configured. The second difference is the noise burst generated at start-up. The user will hear a 500-msec burst of white noise at a loud conversational speech level. The noise burst is a potential annoyance for the user, but the probe signal is also an indicator that the hearing aid is working properly. Thus hearing aid users may well find it reassuring to hear the noise; it gives proof that the hearing aid is operating, much like hearing the sound of the engine when starting an automobile.

Under normal operating conditions, the user will not hear any effect of the feedback cancellation. The feedback cancellation will slowly adapt to changes in the feedback path and will continuously cancel the feedback signal. Successful operation of the feedback cancellation results in an absence of problems that otherwise would have occurred. The user will be able to choose approximately 10 dB more gain than without the feedback cancellation, resulting in higher signal levels and potentially better speech intelligibility if the additional gain results in more speech sounds being elevated above the impaired auditory threshold. But as long as the operating conditions of the hearing aid remain close to those present when it was turned on, there will be very little obvious effect of the feedback cancellation functioning.

Sudden changes in the hearing aid operating environment may result in audible results of the feedback cancellation. If the hearing aid is driven into an unstable gain condition, whistling will be audible until the processing corrects the feedback path model. For example, if bringing a telephone handset up to the ear causes instability, the user will hear a short intense tone burst. The cessation of the tone burst provides evidence that the feedback cancellation is working since the whistling would be continuous if the feedback cancellation were not present. Tone bursts will be possible under any condition that causes a large change in the feedback path; such conditions include the loosening of the earmold in the ear (e.g. sneezing) or blocking the vent in the earmold, as well as using the telephone.

An extreme change in the feedback path may drive the system beyond the ability of the adaptive cancellation filter to provide compensation. If this happens, the user (or those nearby) will notice continuous or intermittent whistling. A potential solution to this problem is for the user to turn the hearing aid off and then on again in the ear. This will generate a noise burst just as when the hearing aid was first turned on, and a new feedback cancellation filter will be designed to match the new feedback path.

Figure 2:
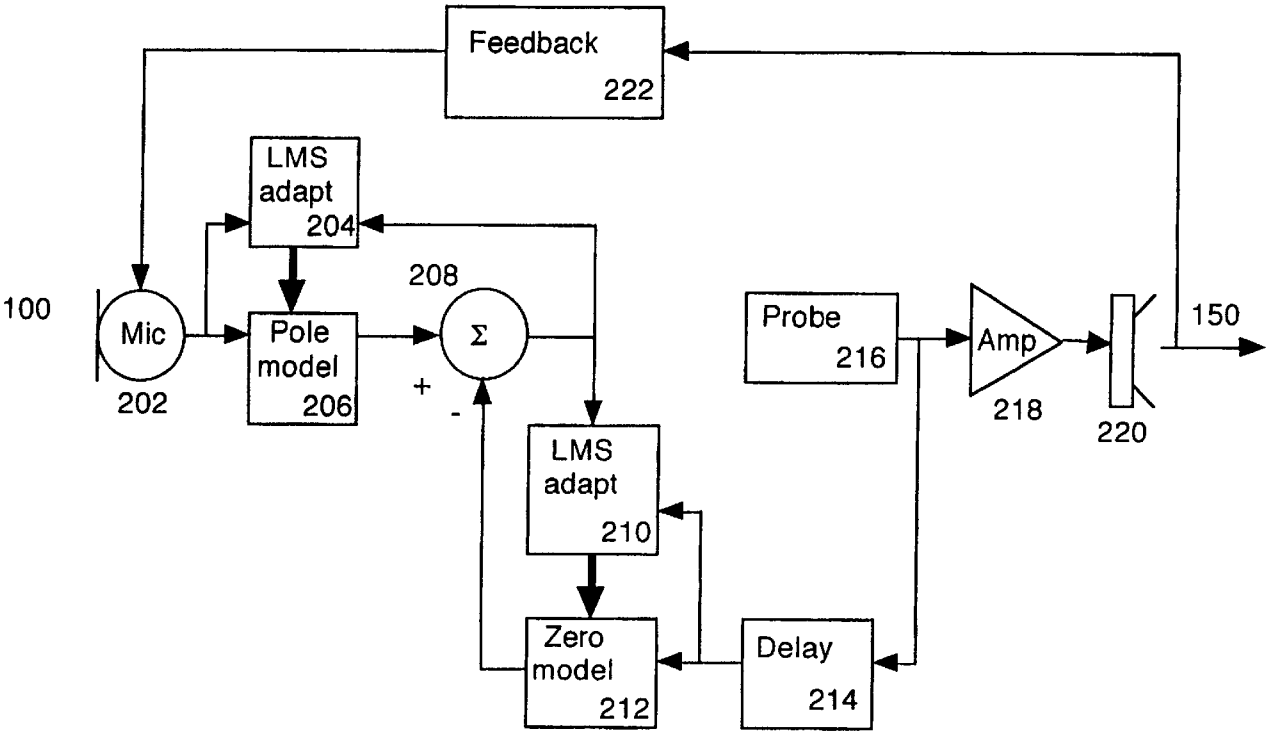
FIG. 2 is a block diagram showing how the initial filter coefficients are determined at start-up in the present invention.
Figure 3:
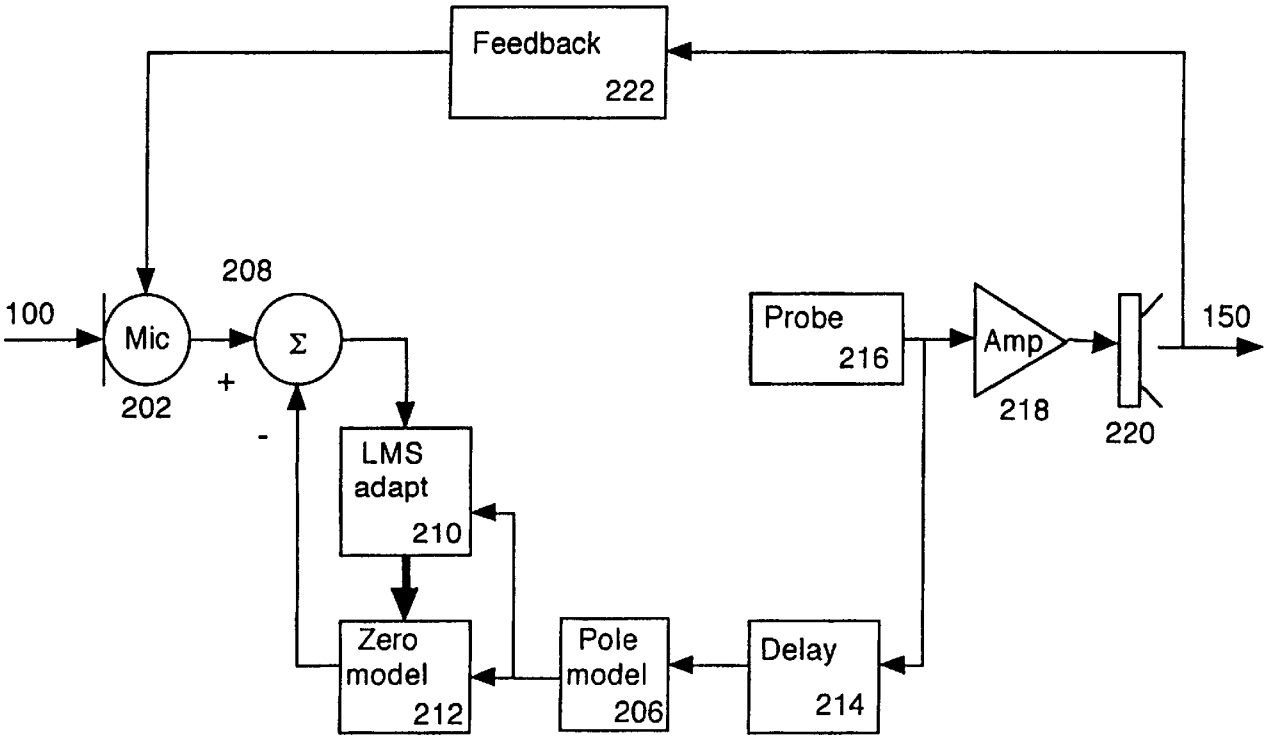
FIG. 3 is a block diagram showing how optimum zero coefficients are determined at start-up in the present invention.

FIGS. 2 and 3 show the details of start-up processing steps 14 and 16 of FIG. 1. The IIR filter is designed when the hearing aid is inserted into the ear. Once the filter is designed, the pole filter coefficients are saved and no further pole filter adaptation is performed. If a complete set of new IIR filter coefficients is needled due to a substantial change in the feedback path, it can easily be generated by turning the hearing aid off and then on again in the ear. The filter poles are intended to model those aspects of the feedback path that can have high-Q resonances but which stay relatively constant during the course of the day. These elements include this microphone 202, power amplifier 218, receiver 220, and the basic acoustics of feedback path 222.

The IIR filter design proceeds in two stages. In the first stage the initial filter pole and zero coefficients are computed. A block diagram is shown in FIG. 2. The hearing aid processing is turned off, and white noise probe signal q(n) 216 is injected into the system instead. During the 250-msec noise burst, the poles and zeroes of the entire system transfer function are determined using an adaptive equation-error procedure. The system transfer function being modeled consists of the series combination of the amplifier 218, receiver 220, acoustic feedback path 222, and microphone 202. The equation-error procedure uses the FIR filter 206 after the microphone to cancel the poles of the system transfer function, and uses the FIR filter 212 to duplicate the zeroes of the system transfer function. The delay 214 represents the broadband delay in the system. The filters 206 and 212 are simultaneously adapted during the noise burst using an LMS algorithm 204, 210. The objective of the adaptation is to minimize the error signal produced at the output of summation 208. When the ambient noise level is low and its spectrum relatively white, minimizing the error signal generates an optimum model of the poles and zeroes of the system transfer function. In the preferred embodiment, a 7-pole/7-zero filter is used.

The poles of the transfer function model, once determined, are modified and then frozen. The transfer function of the pole portion of the IIR model is given by $$D(z) = \frac{1}{1 - \sum_{k=1}^{K} a_k z^{-k}}$$

where K is the number of poles in the model. If the Q of the poles is high, then a small shift in one of the system resonance frequencies could result in a large mismatch between the output of the model and the actual feedback path transfer function. The poles of the model are therefore modified to reduce the possibility of such a mismatch. The poles, once found, are detuned by multiplying the filter coefficients $\{a_k\}$ by the factor $\rho^k$, $0<\rho<1$. This operation reduces the filter Q values by shifting the poles inward from the unit circle in the complex-z plane. The resulting transfer function is given by $$\hat{D}(z) = \frac{1}{1 - \sum_{k=1}^{K} a_k \rho^k z^{-k}} = \frac{1}{1 - \sum_{k=1}^{K} \hat{a}_k z^{-k}}$$

where the filter poles are now represented by the set of coefficients $\{\hat{a}_k\}=\{a_k\rho^k\}$.

The pole coefficients are now frozen and undergo no further changes. In the second stage of the IIR filter design, the zeroes of the IIR filter are adapted to correspond to the modified poles. A block diagram of this operation is shown in FIG. 3. The white noise probe signal 216 is injected into the system for a second time, again with the hearing aid processing turned off. The probe is filtered through delay 214 and thence through the frozen pole model filter 206 which represents the denominator of the modeled system transfer function. The pole coefficients in filter 206 have been detuned as described in the paragraph above to lower the Qvalues of the modeled resonances. The zero coefficients in filter 212 are now adapted to reduce the error between the actual feedback system transfer function and the modeled system incorporating the detuned poles. The objective of the adaptation is to minimize the error signal produced at the output of summation. 208. The LMS adaptation algorithm 210 is again used. Because the zero coefficients computed during the first noise burst are already close to the desired values, the second adaptation will converge quickly. The complete IIR filter transfer function is then given by $$G(z) = \frac{\sum_{m=0}^{M} b_m z^{-m}}{1 - \sum_{k=1}^{K} \hat{a}_k z^{-k}}$$

where M is the number of zeroes in the filter. In many instances, the second adaptation produces minimal changes in the zero filter coefficients. In these cases the second stage can be safely eliminated.

Figure 4:
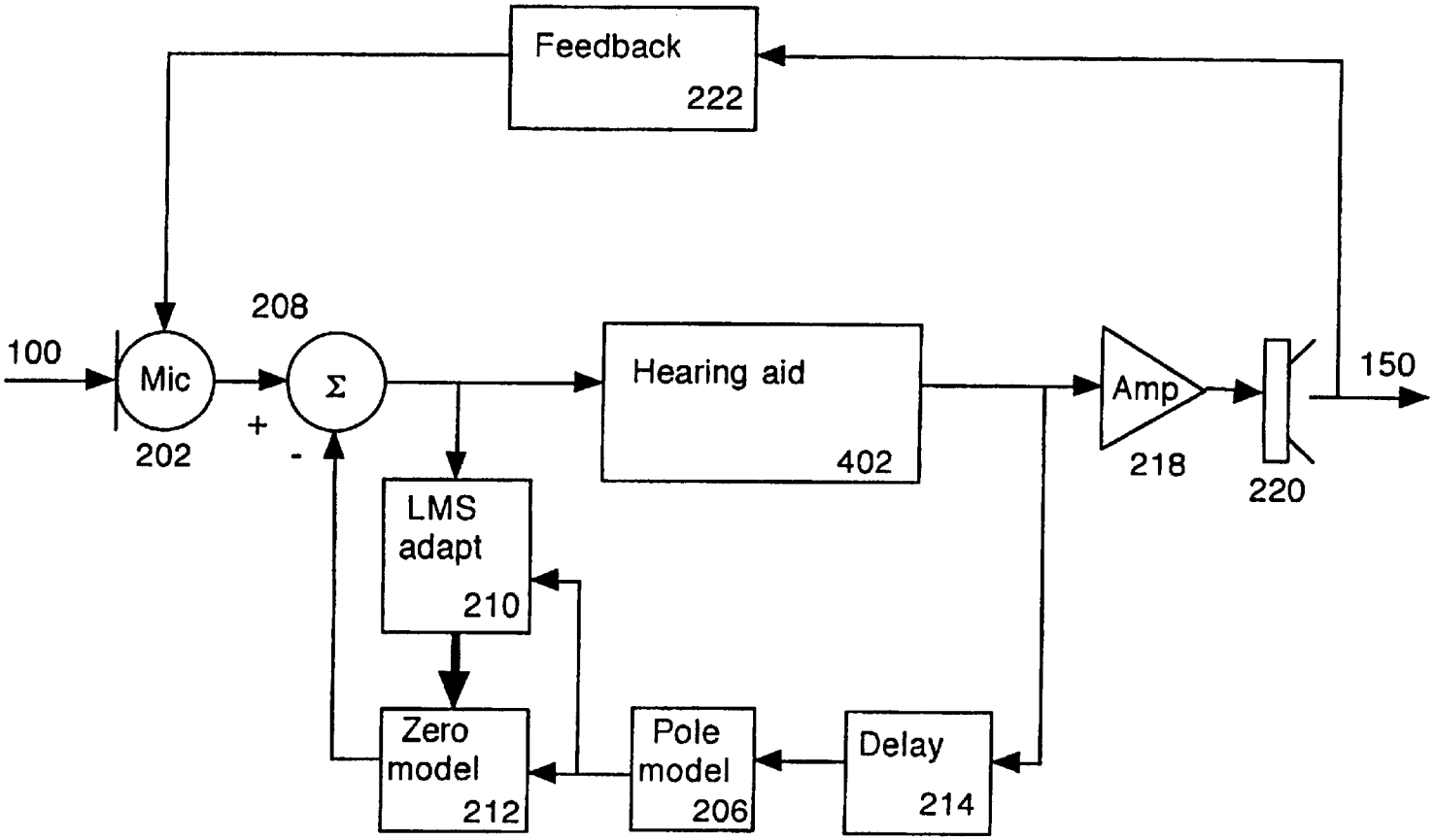
FIG. 4 is a block diagram showing the running adaptation of the zero filter coefficients in a first embodiment of the present invention.

FIG. 4 is a block diagram showing the hearing aid operation of step 18 of FIG. 1, including the running adaptation of the zero filter coefficients, in a first embodiment of the present invention. The series combination of the frozen pole filter 206 and the zero filter 212 gives the model transfer function G(z) determined during start-up. The coefficients of the zero model filter 212 are initially set to the values developed during step 14 of the start-up procedure, but are then allowed to adapt. The coefficients of the pole model filter 206 are kept at the values established during start-up and no further adaptation of these values takes place during normal hearing aid operation. The hearing-aid processing is then turned on and the zero model filter 212 is allowed to continuously adapt in response to changes in the feedback path as will occur, for example, when a telephone handset is brought up to the ear.

During the running processing shown in FIG. 4, no separate probe signal is used, since it would be audible to the hearing aid wearer. The coefficients of zero filter 212 are updated adaptively while the hearing aid is in use. The output of hearing-aid processing 402 is used as the probe. In order to minimize the computational requirements, the LMS adaptation algorithm is used by block 210. More sophisticated adaptation algorithms offering faster convergence are available, but such algorithms generally require much greater amounts of computation and therefore are not as practical for a hearing aid. The adaptation is driven by error signal e(n) which is the output of the summation 208. The inputs to the summation 208 are the signal from the microphone 202, and the feedback cancellation signal produced by the cascade of the delay 214 with the all-pole model filter 206 in series with the zero model filter 212. The zero filter coefficients are updated using LMS adaptation in block 210. The LMS weight update on a sample-by-sample basis is given by $$w(n+1)=w(n)+2\mu e(n)g(n)$$

where w(n) is the adaptive zero filter coefficient vector at time n, e(n) is the error signal, and g(n) is the vector of present and past outputs of the pole model filter 206. The weight update for block operation of the LMS algorithm is formed by taking the average of the weight updates for each sample within the block.

Figure 5:
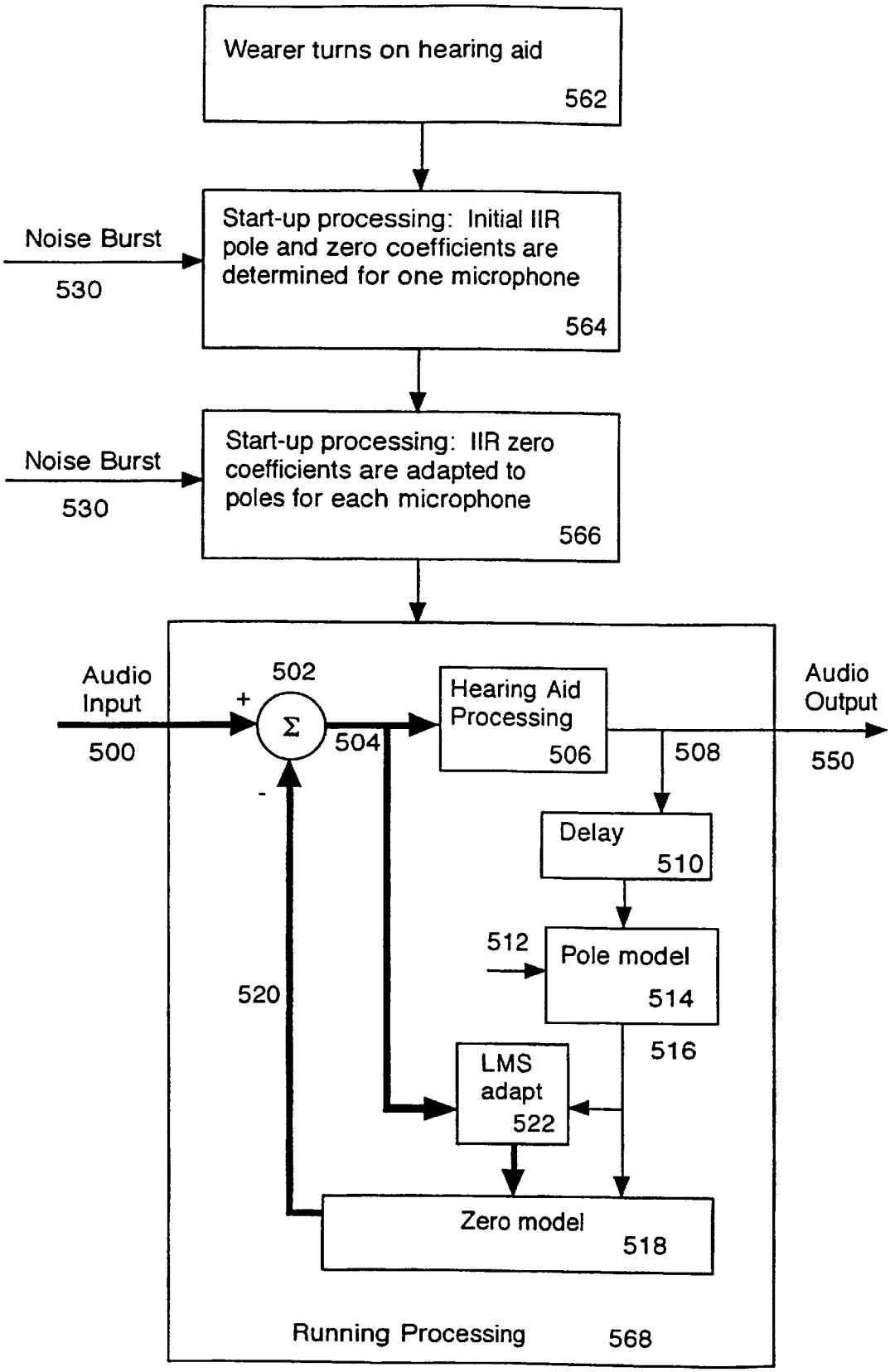
FIG. 5 is a flow diagram showing the operation of a multi-microphone hearing aid according to the present invention.

FIG. 5 is a flow diagram showing the operation of a hearing aid having multiple input microphones. In step 562, the wearer of the hearing aid turns the hearing aid on. Step 564 and 566 comprise the start-up processing operations, and step 568 comprises the running operations as the hearing aid operates. Steps 562, 564, and 566 are similar to steps 14, 16, and 18 in FIG. 1. Step 568 is similar to step 18, except that the signals from two or more microphones are combined to form audio signal 504, which is processed by hearing aid processing 506 and used as an input to LMS adapt block 522.

As in the single microphone embodiment of FIGS. 1–4, the feedback cancellation uses an adaptive filter, such as an IIR filter, along with a short bulk delay. The filter is designed when the hearing aid is turned on in the ear. In step 564, the IIR filter is designed. Then, the denominator portion of the IIR filter is frozen, while the numerator portion of the filter still adapts. In step 566, the initial zero coefficients are modified to compensate for changes to the pole coefficients in step 564. In step 568, the hearing aid is turned on and operates in closed loop. The zero (FIR) filter, consisting of the numerator of the IIR filter developed during start-up, continues to adapt in real time.

In the specific embodiment shown in FIG. 5, audio input 500, from two or more hearing aid microphones (not shown) after subtraction of a cancellation signal 520, is processed by hearing aid processing 506 to generate audio output 550, which is delivered to the hearing aid amplifier (not shown), and signal 508. Signal 508 is delayed by delay 510, which shifts the filter response so as to make the most effective use of the limited number of zero filter coefficients, filtered by all-pole filter 514, and filtered by FIR filter 518 to form a cancellation signal 520, which is subtracted from input signal 500 by adder 502.

FIR filter 518 adapts while the hearing aid is in use, without the use of a separate probe signal. In the embodiment of FIG. 5, the FIR filter coefficients are generated in LMS adapt block 522 based upon error signal 504 (out of adder 502) and input 516 from all-pole filter 514. All-pole filter 514 may be frozen, or may adapt slowly based upon input 512 (which might be based upon the output(s) of adder 502 or signal 508).

Figure 6:
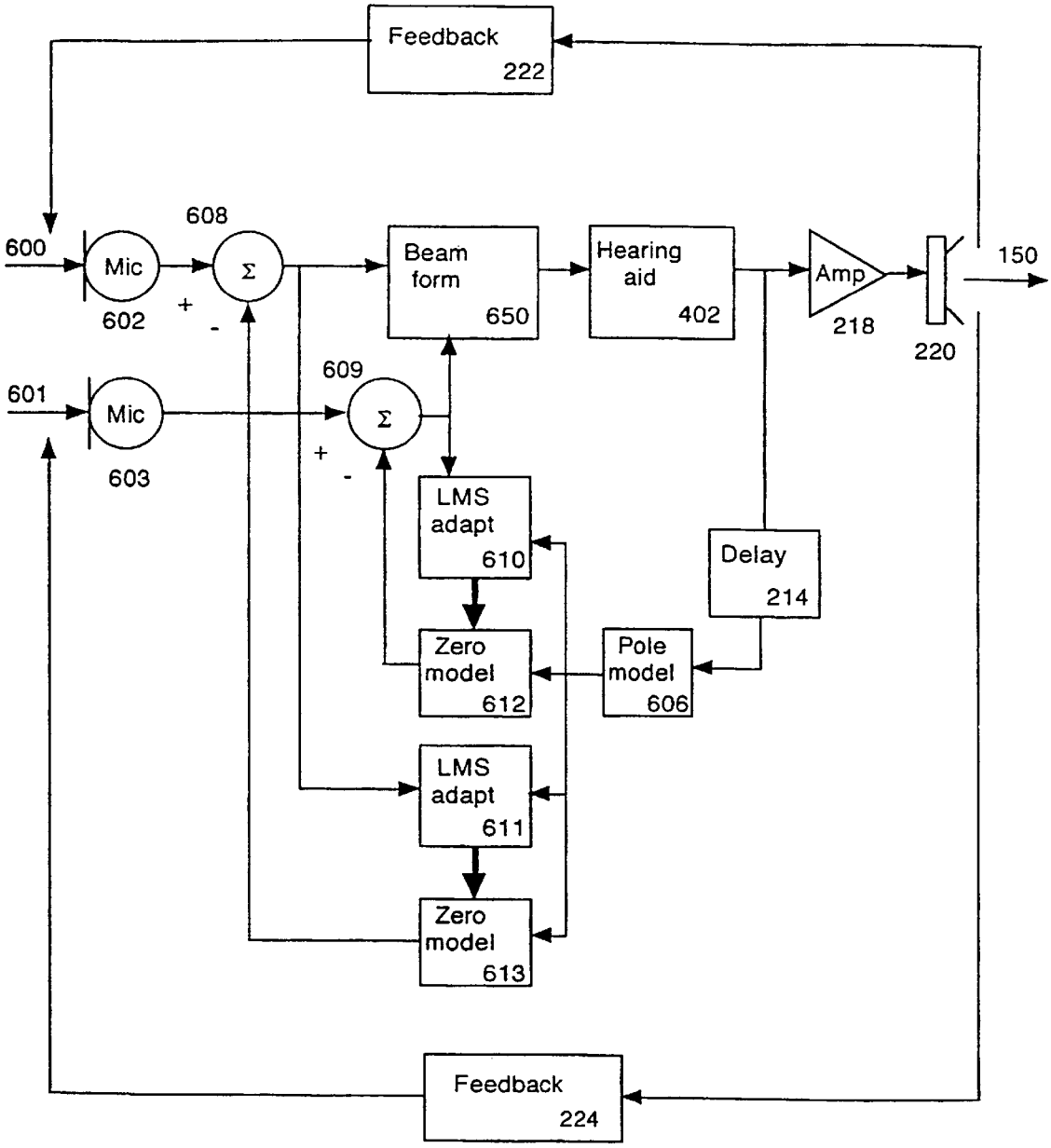
FIG. 6 is a block diagram showing the running adaptation of the FIR filter weights in a second embodiment of the present invention, for use with two or more microphones.

FIG. 6 is a block diagram showing the processing of step 568 of FIG. 5, including running adaptation of the FIR filter weights, in a second embodiment of the present invention, for use with two microphones 602 and 603. The purpose of using two or more microphones in the hearing aid is to allow adaptive or switchable directional microphone processing. For example, the hearing aid could amplify the sound signals coming from in front of the wearer while attenuating sounds coming from behind the wearer.

FIG. 6 shows a preferred embodiment of a two input (600, 601) hearing aid according to the present invention. This embodiment is very similar to that shown in FIG. 4, and elements having the same reference number are the same.

In the embodiment shown in FIG. 6, feedback 222, 224 is canceled at each of the microphones 602, 603 separately before the beamforming processing stage 650 instead of trying to cancel the feedback after the beamforming output to hearing aid 402. This approach is desired because the frequency response of the acoustic feedback path at the beamforming output could be affected by the changes in the beam directional pattern.

Beamforming 650 is a simple and well known process. Beam form block 650 selects the output of one of the omnidirectional microphones 602, 603 if a nondirectional sensitivity pattern is desired. In a noisy situation, the output of the second (rear) microphone is subtracted from the first (forward) microphone to create a directional (cardioid) pattern having a null towards the rear. The system shown in FIG. 6 will work for any combination of microphone outputs 602 and 603 used to form the beam.

The coefficients of the zero model filters 612, 613 are adapted by LMS adapt blocks 610, 611 using the error signals produced at the outputs of summations 609 and 608, respectively. The same pole model filter 606 is preferably used for both microphones. It is assumed in this approach that the feedback paths at the two microphones will be quite similar, having similar resonance behavior and differing primarily in the time delay and local reflections at the two microphones. If the pole model filter coefficients are designed for the microphone having the shortest time delay (closest to the vent opening in the earmold), then the adaptive zero model filters 612, 613 should be able to compensate for the small differences between the microphone positions and errors in microphone calibration. An alternative would be to determine the pole model filter coefficients for each microphones separately at start-up, and then form the pole model filter 606 by taking the average of the individual microphone pole model coefficients (Haneda, Y., Makino, S., and Kaneda, Y., "Common acoustical pole and zero modeling of room transfer functions", IEEE Trans. Speech and Audio Proc., Vol. 2, pp 320–328, 1974). The price paid for this feedback cancellation approach is an increase in the computational burden, since two adaptive zero model filters 612 and 613 must be maintained instead of just one. If 7 coefficients are used for the pole model filter 606, and 8 coefficients used for each LMS adaptive zero model filter 612 and 613, then the computational requirements go from about 0.4 MIPS for a single adaptive FIR filter to 0.65 MIPS when two are used.

Figure 7:
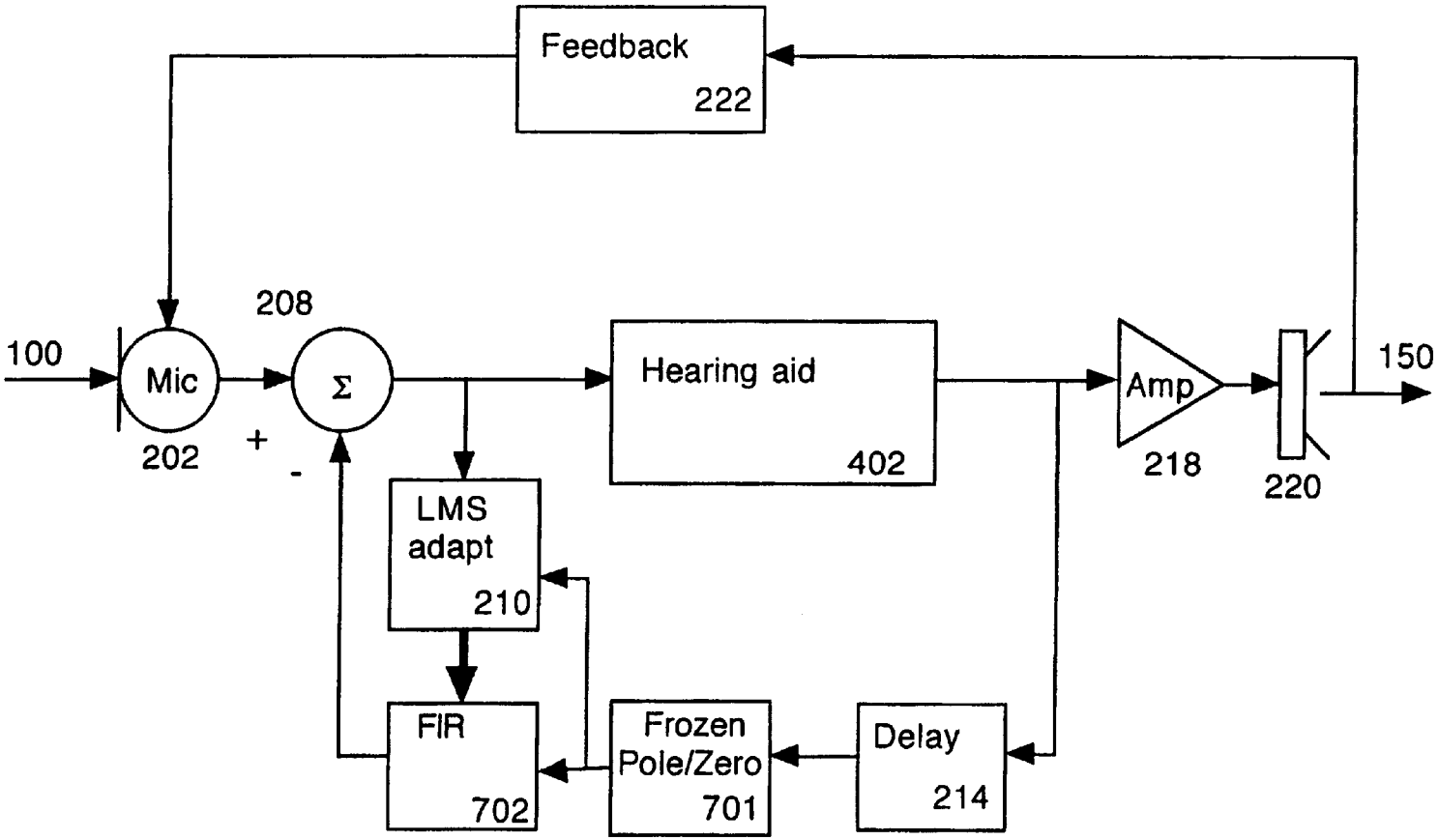
FIG. 7 is a block diagram showing the running adaptation of a third embodiment of the present invention, utilizing an adaptive FIR filter and a frozen IIR filter.

FIG. 7 is a block diagram showing the running adaptation of a third embodiment of the present invention, utilizing an adaptive FIR filter 702 and a frozen IIR filter 701. This embodiment is not as efficient as the embodiment of FIGS. 1–4, but will accomplish the same purpose. Initial filter design of IIR filter 701 and FIR filter 702 is accomplished is very similar to the process shown in FIG. 1, except that step 14 designs the poles and zeroes of FIR filter 702, which are detuned and frozen, and step 16 designs FIR filter 702. In step 18, all of IIR filter 701 is frozen, and FIR filter 702 adapts as shown.

Figure 8:
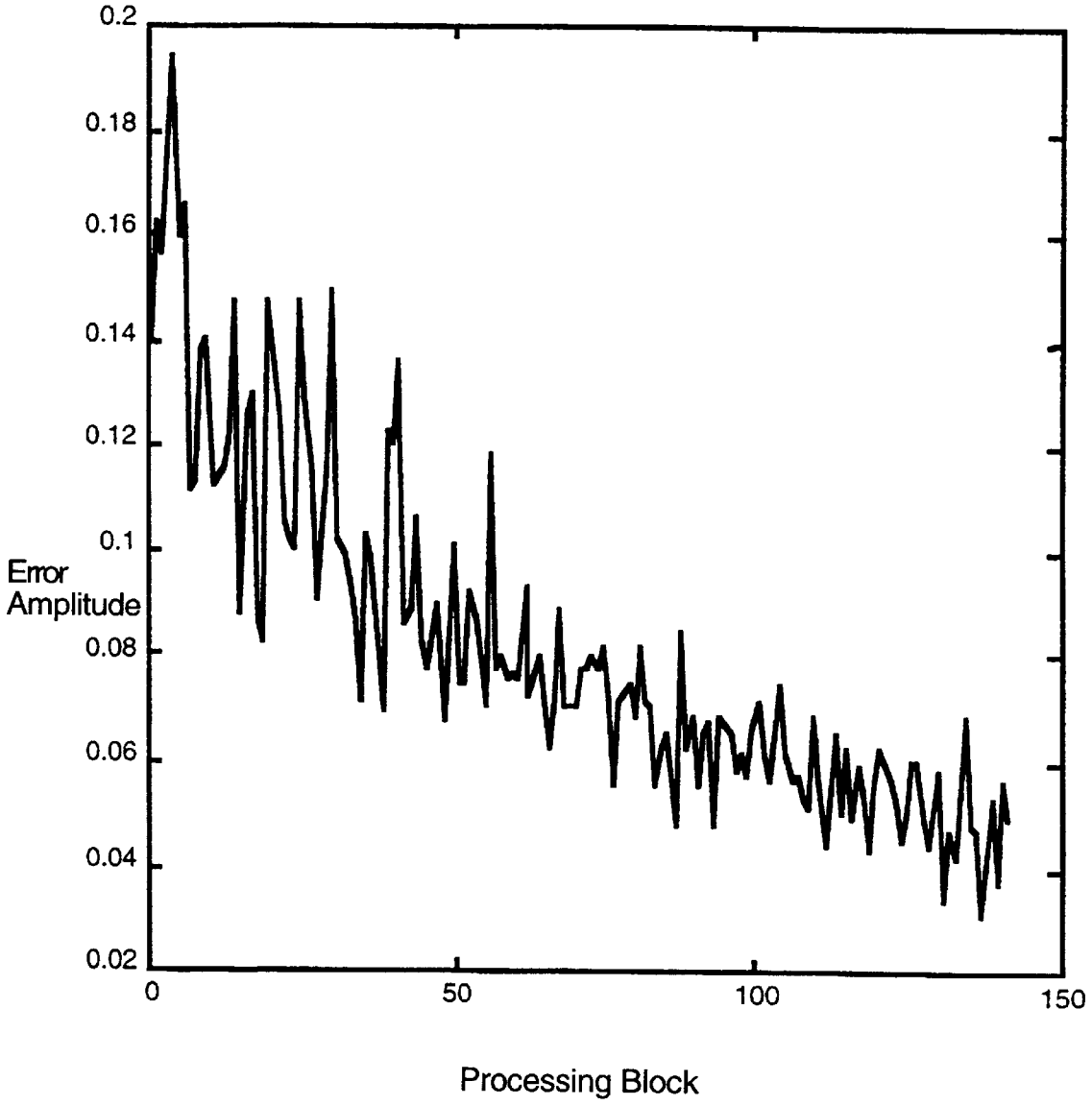
FIG. 8 is a plot of the error signal during initial adaptation of the embodiment of FIGS. 1–4.

FIG. 8 is a plot of the error signal during initial adaptation, for the embodiment of FIGS. 1–4. The figure shows the error signal 104 during 500 msec of initial adaptation. The equation-error formulation is being used, so the pole and zero coefficients are being adapted simultaneously in the presence of white noise probe signal 216. The IIR feedback path model consists of 4 poles and 7 zeroes, with a bulk delay adjusted to compensate for the delay in the block processing. These data are from a real-time implementation using a Motorola 56000 family processor embedded in an AudioLogic Audallion and connected to a Danavox behind the ear (BTE) hearing aid. The hearing aid was connected to a vented earmold mounted on a dummy head. Approximately 12 dB of additional gain was obtained using the adaptive feedback cancellation design of FIGS. 1–4.

Figure 9:
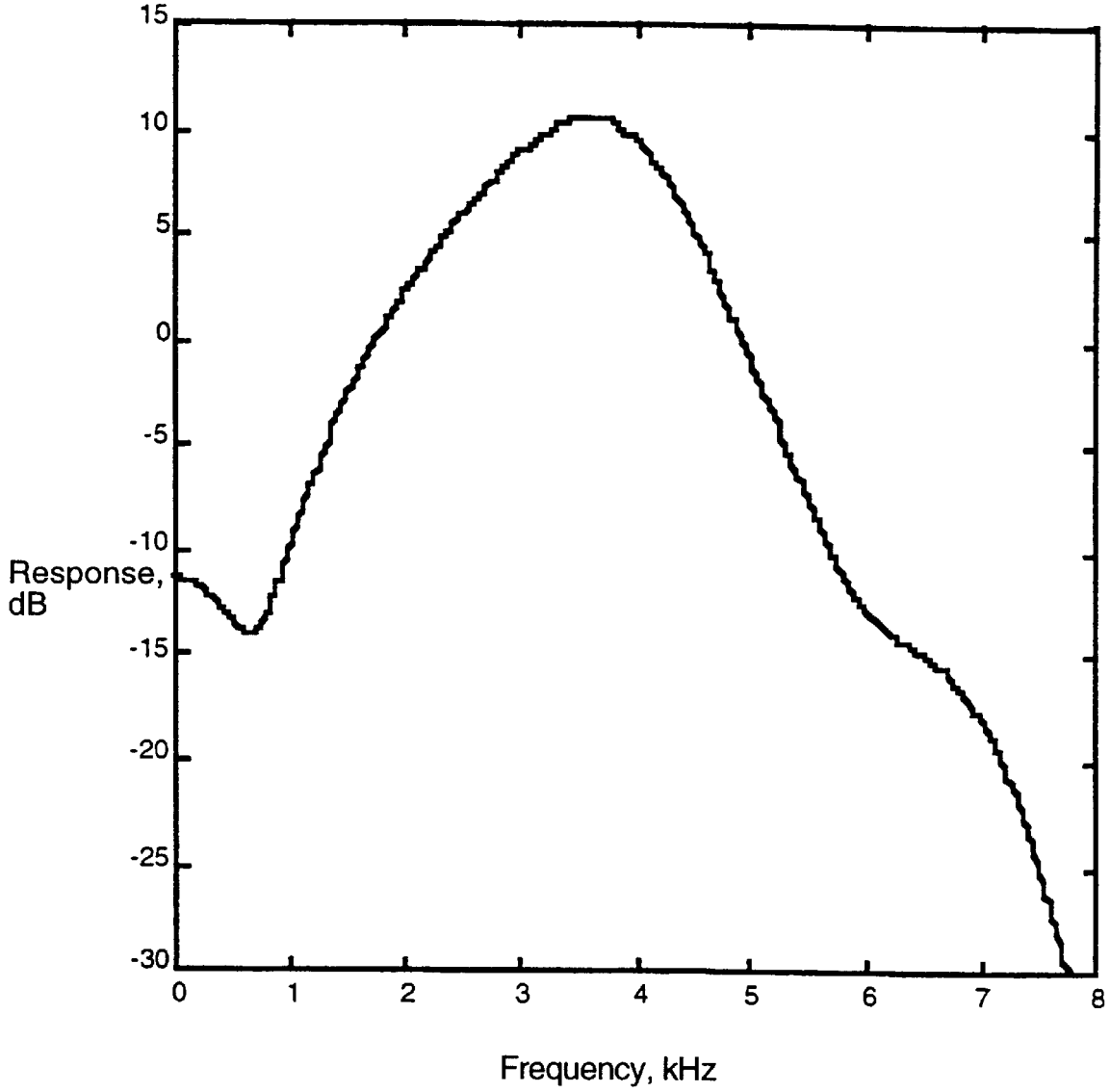
FIG. 9 is a plot of the magnitude frequency response of the IIR filter after initial adaptation, for the embodiment of FIGS. 1–4.

FIG. 9 is a plot of the frequency response of the IIR filter after initial adaptation, for the embodiment of FIGS. 1–4. The main peak at 4 KHz is the resonance of the receiver (output transducer) in the hearing aid. Those skilled in the art will appreciate that the frequency response shown in FIG. 9 is typical of hearing aid, having a wide dynamic range and expected shape and resonant value.

While the exemplary preferred embodiments of the present invention are described herein with particularity, those skilled in the art will appreciate various changes, additions, and applications other than those specifically mentioned, which are within the spirit of this invention.

What is claimed is:

1. A hearing aid comprising:

a microphone for converting sound into an audio signal;

feedback cancellation means including means for estimating a physical feedback signal of the hearing aid, and means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal; and speaker means, connected to the output of the hearing aid processing means, for converting the processed compensated audio signal into a sound signal;

wherein said feedback cancellation means forms a feedback path from the output of the hearing aid processing means to the input of the subtracting means and includes a first filter for modeling near constant factors in the physical feedback path, and a second, quickly varying, filter for modeling variable factors in the feedback path;

wherein the first filter varies substantially slower than the second filter.

2. The hearing aid of claim 1, further including:

means for designing the first filter when the hearing aid is turned on; and means for freezing the first filter design.

3. The hearing aid of claim 2, further including:

means for designing the second filter when the hearing aid is turned on; and means for adapting the second filter based upon the output of the subtracting means and based upon the output of the hearing aid processing means.

4. The hearing aid of claim 3, wherein the first filter is an IIR filter and the second filter is an FIR filter.

5. The hearing aid of claim 3, wherein the means for designing the first filter and the means for designing the second filter comprise:

means for disabling the input to the speaker means from the hearing aid processing means;

probe means for providing a test signal to the input of the speaker means and to the second filter;

means for connecting the output of the microphone to the input of the first filter;

means for connecting the output of the first filter and the output of the second filter to the subtraction means;

means for designing the second filter based upon the test signal and the output of the subtraction means; and means for designing the first filter based upon the output of the microphone and the output of the subtraction means.

6. The hearing aid of claim 5, wherein the means for designing the first filter further includes means for detuning the filter, and the means for designing the second filter further includes means for adapting the second filter to the detuned first filter.

7. The hearing aid of claim 3, wherein the first filter is the denominator of an IIR filter and the second filter is the numerator of said IIR filter.

8. The hearing aid of claim 7, wherein the first filter is connected to the output of the hearing aid processing means, for filtering the output of the hearing aid processing means, and the output of the first filter is connected to the input of the second filter, for providing the filtered output of the hearing aid processing means to the second filter.

9. The hearing aid of claim 1, further including:

means for designing the first filter when the hearing aid is turned on;

means for designing the second filter when the hearing aid is turned on;

means for slowly adapting the first filter; and means for rapidly adapting the second filter based upon the output of the subtracting means and based upon the output of the hearing aid processing means.

10. The hearing aid of claim 9, wherein the means for adapting the first filter adapts the first filter based upon the output of the subtracting means.

11. The hearing aid of claim 9, wherein the means for adapting the first filter adapts the first filter based upon the output of the hearing aid processing means.

12. A hearing aid comprising:

a first microphone for converting sound into a first audio signal;

a second microphone for converting sound into a second audio signal;

feedback cancellation means including means for estimating physical feedback signals to each microphone of the hearing aid, and means for modelling a first signal processing feedback signal to compensate for the estimated physical feedback signal to the first microphone and a second signal processing feedback signal to compensate for the estimated physical feedback signal to the second microphone;

means for subtracting the first signal processing feedback signal from the first audio signal to form a first compensated audio signal;

means for subtracting the second signal processing feedback signal from the second audio signal to form a second compensated audio signal;

beamforming means, connected to each subtracting means, to combine the compensated audio signals into a beamformed signal;

hearing aid processing means, connected to the beamforming means, for processing the beamformed signal; and speaker means, connected to the output of the hearing aid processing means, for converting the processed beamformed signal into a sound signal;

wherein said feedback cancellation means includes a slower varying filter, connected to the output of the hearing aid processing means, for modeling near constant environmental factors in one of the physical feedback paths;

a first quickly varying filter, connected to the output of the slower varying filter and providing an input to the first subtraction means, for modeling variable factors in the first feedback path; and a second quickly varying filter, connected to the output of the slower varying filter and providing an input to the second subtraction means, for modeling variable factors in the second feedback path;

wherein said slower varying filter varies substantially slower than said quickly varying filters.

13. The hearing aid of claim 12, further including:

means for designing the slower varying filter when the hearing aid is turned on; and means for freezing the slower varying filter design.

14. The hearing aid of claim 13, further including: means for designing the first and second quickly varying filters when the hearing aid is turned on;

means for adapting the first quickly varying filter based upon the output of the first subtracting means and based upon the output of the hearing aid processing means; and means for adapting the second quickly varying filter based upon the output of the second subtracting means and based upon the output of the hearing aid processing means.

15. The hearing aid of claim 14, wherein the slower varying filter is an IIR filter and the rapidly varying filters are FIR filters.

16. The hearing aid of claim 14, wherein the means for designing the slower varying filter and the means for designing the rapidly varying filters comprise:

means for disabling the input to the speaker means from the hearing aid processing means;

probe means for providing a test signal to the input of the speaker means and to the rapidly varying filters;

means for connecting the output of the first microphone to the input of the slower varying filter;

means for connecting the output of the slower varying filter and the output of the first rapidly varying filter to the first subtraction means;

means for designing the first rapidly varying filter based upon the test signal and the output of the first subtraction means;

means for connecting the output of the slower varying filter and the output of the second rapidly varying filter to the second subtraction means;

means for designing the second rapidly varying filter based upon the test signal and the output of the second subtraction means; and means for designing the slower varying filter based upon the output of the microphone and the output of at least one of the subtraction means.

17. The hearing aid of claim 16, wherein the means for designing the slower varying filter further includes means for detuning the slower varying filter, and the means for designing the quickly varying filters further includes means for adapting the quickly varying filters to the detuned slower varying filter.

18. The hearing aid of claim 14, wherein the first quickly varying filter is the denominator of a first IIR filter, the second quickly varying filter is the denominator of a second IIR filter, and the slower varying filter is based upon the numerator of at least one of said first and second IIR filters.

19. The hearing aid of claim 12, further including:

means for designing the slower varying filter when the hearing aid is turned on;

means for designing the quickly varying filters when the hearing aid is turned on;

means for slowly adapting the slower varying filter;

means for rapidly adapting the first quickly varying filter based upon the output of the first subtracting means and based upon the output of the hearing aid processing means; and means for rapidly adapting the second quickly varying filter based upon the output of the second subtracting means and based upon the output of the hearing aid processing means.

20. The hearing aid of claim 19, wherein the means for adapting the slower varying filter adapts the slower varying filter based upon the output of at least one of the subtracting means.

21. The hearing aid of claim 19, wherein the means for adapting the slower varying filter adapts the slower varying filter based upon the output of the hearing aid processing means.

22. A method for compensating for feedback noise in a hearing aid comprising the steps of:

turning on the hearing aid;

configuring the hearing aid to operate in an open loop manner;

inserting a test signal into the hearing aid output;

estimating the feedback noise;

designing a first, slower varying filter and a second, quickly varying filter to form a feedback path within the hearing aid to compensate for the estimated feedback noise;

configuring the hearing aid to operate in a closed loop manner; and adapting at least the second filter to account for changes in the feedback environment.

23. The method of claim 22, further comprising the steps while operating in open loop of:

freezing the first filter after the designing step;

detuning the first filter; and adapting the second filter to the detuned first filter.

24. The method of claim 22, further comprising the step of:

slowly adapting the first filter to account for slowly changing factors in the feedback path.

* * * * *

UNITED STATES PATENT AND TRADEMARK OFFICE

CERTIFICATE OF CORRECTION

PATENT NO. : 6,072,884
DATED : June 6, 2000
INVENTOR(S) : James Mitchell Kates

It is certified that error appears in the above-identified patent and that said Letters Patent is hereby corrected as shown below:

Column 3, line 60, delete "paths" and insert --path--.

Column 5, line 45, delete "tile" and insert --the--.

Column 8, line 49, delete "needled" and insert --needed--.

Signed and Sealed this

Eighth Day of May, 2001

*Attest:*

Nicholas P. Godici

NICHOLAS P. GODICI

*Attesting Officer*

*Acting Director of the United States Patent and Trademark Office*